US011006698B2

(12) United States Patent
Honda et al.

(10) Patent No.: US 11,006,698 B2
(45) Date of Patent: May 18, 2021

(54) CLIP FOR RETAINING A KNOT AND METHODS OF USE THEREOF

(71) Applicants: Linton Honda, Rancho Palo Verdes, CA (US); Stephanie Honda, Rancho Palos Verdes, CA (US); Nicholas Honda, Rancho Palos Verdes, CA (US)

(72) Inventors: Linton Honda, Rancho Palo Verdes, CA (US); Stephanie Honda, Rancho Palos Verdes, CA (US); Nicholas Honda, Rancho Palos Verdes, CA (US)

( * ) Notice: Subject to any disclaimer, the term of this patent is extended or adjusted under 35 U.S.C. 154(b) by 0 days.

(21) Appl. No.: 16/158,152

(22) Filed: Oct. 11, 2018

(65) Prior Publication Data

US 2020/0113290 A1 Apr. 16, 2020

(51) Int. Cl.
*A43C 7/00* (2006.01)

(52) U.S. Cl.
CPC ..... *A43C 7/005* (2013.01)

(58) Field of Classification Search
CPC .. A43C 7/00; A43C 7/04; A43C 11/14; A43C 1/00; A43C 7/08; A43C 7/005; Y10T 24/3916; Y10T 24/37; Y10T 24/3703; Y10T 24/3705; Y10T 24/3918; Y10T 24/3718; Y10T 2424/2724; F16G 11/04; F16G 11/44
USPC ..... 114/114, 218
See application file for complete search history.

(56) References Cited

U.S. PATENT DOCUMENTS 322,501 A * 7/1885 Taylor ..... F16G 11/00 24/129 R
2002/0000027 A1* 1/2002 Andersen ..... A44B 99/00 24/535

* cited by examiner

*Primary Examiner* — Jack W Lavinder
(74) *Attorney, Agent, or Firm* — Scott H. Davison; Musick Davison LLP

(57) ABSTRACT

A shoe lace clip for securing shoe laces or a shoe lace knot is provided, the shoe lace clip being formed from a single piece of substantially rigid material and including a base portion with a clip portion extending therefrom, the clip portion having a top jaw and bottom jaw separated by a fixed clip opening, the fixed clip opening having a patterned surface of curved grooves and rounded teeth for retaining a shoe lace or knot therein. The base portion may also include an eyelet opening extending therethrough and disposed perpendicularly to the fixed clip opening for threading the shoe lace in order to further retain the shoe lace clip on the shoe lace.

16 Claims, 10 Drawing Sheets

100

CLIP FOR RETAINING A KNOT AND METHODS OF USE THEREOF

BACKGROUND

Field of the Invention

Provided herein is a clip for retaining shoe laces, and more particularly to a single-piece construction clip with a fixed, rigid opening and a series of curved serrations which safely and securely retain one or more shoe laces individually or tied in a knot.

Related Art

Shoe laces remain the best option to-date for comfortably securing a shoe to a user's foot. Despite the advent of straps, buckles and elastic cords, none of these options can retain a shoe on a user's foot as well as a series of laces running along a top of the shoe with a knot at the end. Straps such as VELCRO® often cannot withstand the stress of athletic activities, have difficulties holding up to water and extreme temperatures, and also have the negative stigma of being associated with small children. However, the primary disadvantage of shoe laces is their inability to retain the knot and prevent the laces from becoming untied. Not only is an untied shoelace inconvenient and an annoyance, it can be dangerous if a person trips over the untied laces or gets them caught or stuck in another object. This is particularly noticeable during physical activity such as running, hiking or playing sports, where it is imperative that a shoe lace knot stay in place so as not to cause a person to stop their activity or trip and fall over an untied shoe lace during the activity.

Various mechanisms have been devised to attempt to keep a shoe lace from becoming untied, including the common method of double-knotting the laces. However, double knots still come untied or can be very difficult to untie if the knot is too tight. Numerous other devices have been developed over the years to attempt to keep a shoe lace knot in place, but they all suffer from various limitations. Many require covering large portions of the shoe or going through complicated, time intensive steps to install and remove. Others are fragile and easily break if they have hinges, springs or other moving parts, while others simply do not work well to retain a shoe lace knot.

Therefore, it is desirable to develop a device which can retain shoe laces or a shoe lace knot and prevent the knot from coming untied without the limitations of the existing devices and methods.

SUMMARY

Embodiments described herein provide for a shoe lace clip formed from a single piece of substantially rigid material, the shoe lace clip having a base portion with a clip portion extending therefrom, the clip portion having a top jaw and bottom jaw separated by a fixed clip opening, the fixed clip opening having a patterned surface of curved grooves and rounded teeth for retaining a shoe lace or knot therein. The base portion may also include an eyelet opening extending therethrough and disposed perpendicularly to the fixed clip opening for threading the shoe lace in order to further retain the shoe lace clip on the shoe lace.

In one embodiment, a shoe lace clip comprises a clip portion with an upper jaw and a lower jaw separated by a fixed clip opening, the fixed clip opening having a patterned surface of curved grooves and rounded teeth; and a base portion extending from the clip portion, the base portion including an eyelet disposed therethrough.

In another embodiment, a method of manufacturing the shoe lace clip comprises the steps of forming a base portion and clip portion; forming a clip opening in the clip portion; forming a patterned surface of curved grooves and rounded teeth into interior surfaces of the clip opening; and forming an eyelet into the base portion.

Other features and advantages of the present invention will become more readily apparent to those of ordinary skill in the art after reviewing the following detailed description and accompanying drawings.

BRIEF DESCRIPTION OF THE DRAWINGS

The structure and operation of the present invention will be understood from a review of the following detailed description and the accompanying drawings in which like reference numerals refer to like parts and in which.

DETAILED DESCRIPTION

Figure 1:
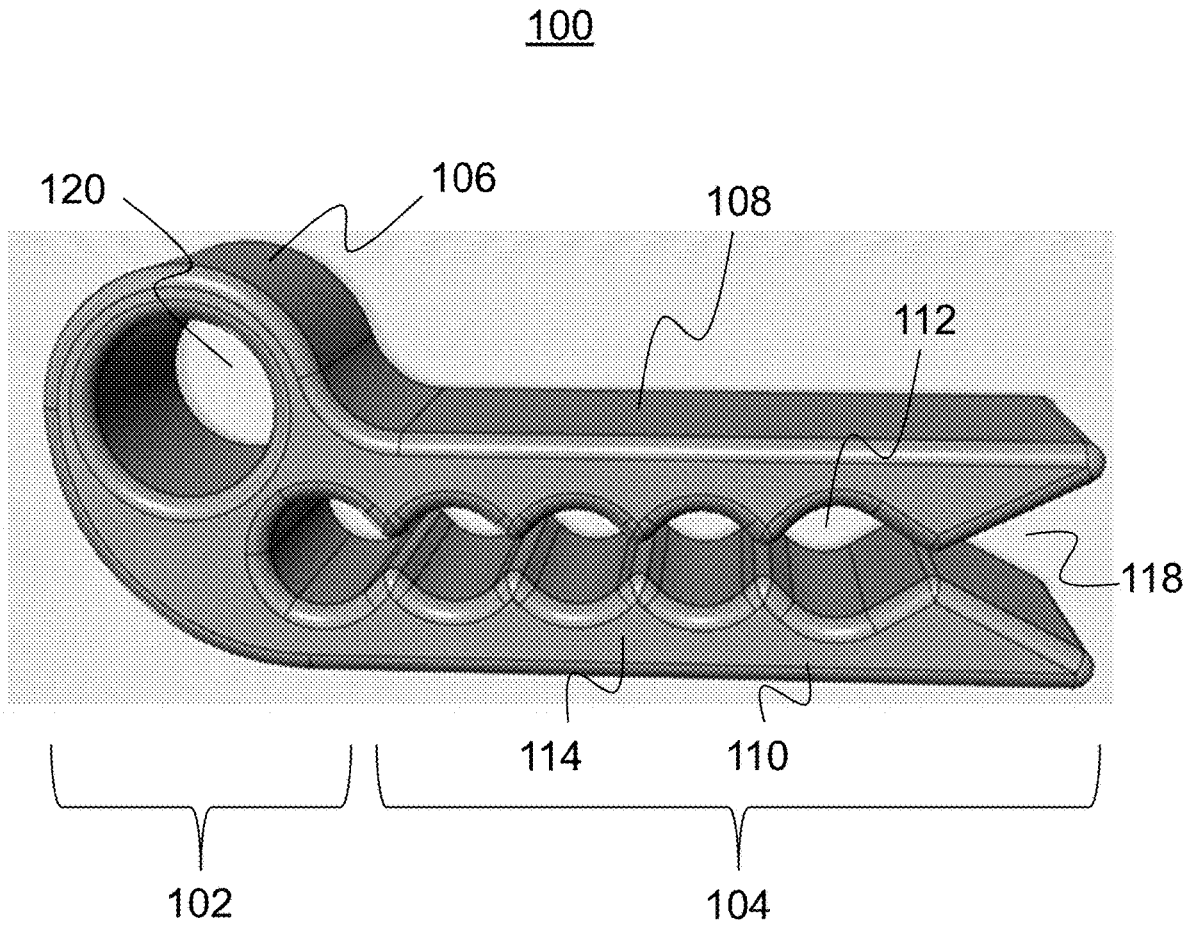
FIG. 1 is a perspective side view illustration of a shoe lace clip, according to an embodiment of the invention.

Certain embodiments disclosed herein provide for a shoe lace clip for securing shoe laces either individually or tied in a knot. For example, the shoe lace clip may be formed from a single piece of substantially rigid material and include a base portion and a clip portion extending therefrom, the clip portion having a top jaw and bottom jaw separated by a fixed clip opening. The fixed clip opening may have a patterned surface of curved grooves and rounded teeth for securely retaining a shoe lace or knot therein without causing damage to the lace or knot. The base portion may also include an eyelet opening extending therethrough and disposed perpendicularly to the fixed clip opening for threading the shoe lace clip in order to further retain the shoe lace clip on the shoe lace.

The shoe lace clip described herein is formed from a single piece of substantially rigid material without a hinge, spring, button or other mechanical means such that the clip opening has an essentially fixed width that allows only a small amount of flexibility for inserting the shoe laces or shoe lace knot into the clip opening. The mouth of the clip opening is angled from a large width to a smaller width to aid in sliding the laces or knot into the clip opening, and all of the edges on the mouth are rounded to prevent snagging against the threads of the laces.

The interior spaces of the clip opening may have a patterned surface of curved grooves and rounded teeth to retain the laces within the opening but also prevent snagging or tearing of the laces as they are being inserted or removed from the clip opening. The curved grooves may be disposed on two opposing surfaces of the clip opening in order to form a plurality of rounded lace retention shapes which further secure the laces or knot within the retention shapes, and the rounded teeth may also be disposed on opposing surfaces in order to form smaller gaps between the retention shapes to further secure the laces.

The eyelet disposed in the base portion will keep the shoe lace clip secured to one of the shoe laces when the user is not wearing the shoe (or even when the user is wearing the shoe) and may even be designed to be sewn into the shoe or laces as a permanent attachment.

As noted above, the shoe lace clip may be formed from a single piece of material such as an ABS (acrylonitrile butadiene styrene) plastic which is resilient, unlikely to break and provides a small amount of flexibility to allow the clip opening to stretch while sliding over the laces or knot. The material may be manufactured through extrusion or printed with a 3D printer or other additive manufacturing method to significantly reduce the overall manufacturing cost, and the single piece construction improves the durability by removing any moving parts such as hinges or springs. The shoe lace clip may be fabricated from a variety of different materials, including other plastics such as polylactic acid (PLA), a variety of different metals, and even wood. All of these substantially rigid materials allow for a single-piece construction, are durable, and provide a sufficient amount of flexibility to allow the clip portion to expand and contract around the shoe laces.

The use of the eyelet, hinge-less clip opening, durable material and single piece construction make the shoe lace clip kid friendly and easy to use for any age group or physical ability.

After reading this description it will become apparent to one skilled in the art how to implement the invention in various alternative embodiments and alternative applications. However, although various embodiments of the present invention will be described herein, it is understood that these embodiments are presented by way of example only, and not limitation. As such, this detailed description of various alternative embodiments should not be construed to limit the scope or breadth of the present invention as set forth in the appended claims.

FIG. 1 illustrates one embodiment of a shoe lace clip 100, including a base portion 102 and a clip portion 104 which extends away from the base portion 102 to form the clip. The base portion 102 may be formed in a substantially cylindrical shape, with the clip portion 104 extending from a curved, side portion 106 of the cylindrical shape such that an upper jaw 108 and lower jaw 110 of the clip portion 104 are co-extensive with the side portion 106 of the base portion 102. The clip portion 104 includes a fixed clip opening 112 disposed along a substantial length of the clip portion 104 between the upper jaw 108 and lower jaw 110 for retaining the shoe laces or knot. The fixed clip opening 112 is open on three sides, including first and second lateral sides 114 and 116 of the clip 100 (116 shown in FIG. 2B) and a mouth 118 disposed on an opposite end from where the clip portion 104 extends from the base portion 102.

The base portion 102 may include an eyelet 120 disposed through the substantially cylindrical shape and extending laterally through the base portion 102 from the first lateral side 114 to the second lateral side 116 and substantially perpendicular to an angle that the clip portion 104 extends from the base portion 102. The positioning of the eyelet 120 allows the shoe lace clip to be threaded with a shoe lace through the eyelet 120 to secure the shoe lace clip 100 to a shoe lace extending laterally across a top portion of a shoe, and then also be secured over a knot or set of shoe laces disposed above or below the shoe lace, as shown more clearly in FIGS. 8A and 8B. The eyelet 120 operates to secure the shoe lace clip 100 to the laces if the laces are untied, and also helps keep the shoe lace clip fixed on the shoe when it is clipped over the shoe lace knot. In this embodiment, the shape of the eyelet 120 is cylindrical, which optimizes the strength to mass ratio of the clip and reduces stress risers at certain stress points on the device; however the shape of the eyelet could be altered into a rectangular shape, hexagonal shape, and so on if needed for design purposes or to match a similarly-shaped base portion.

Figure 2A:
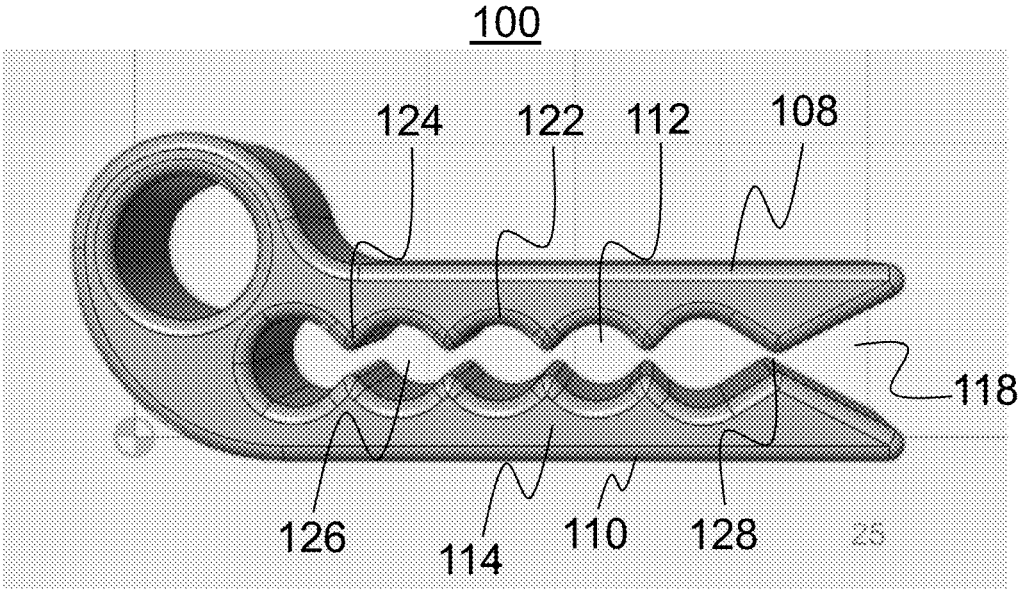
FIGS. 2A, 2B and 2C are side view illustrations of a left side and a right side of the shoe lace clip, according to an embodiment of the invention.
Figure 2B:
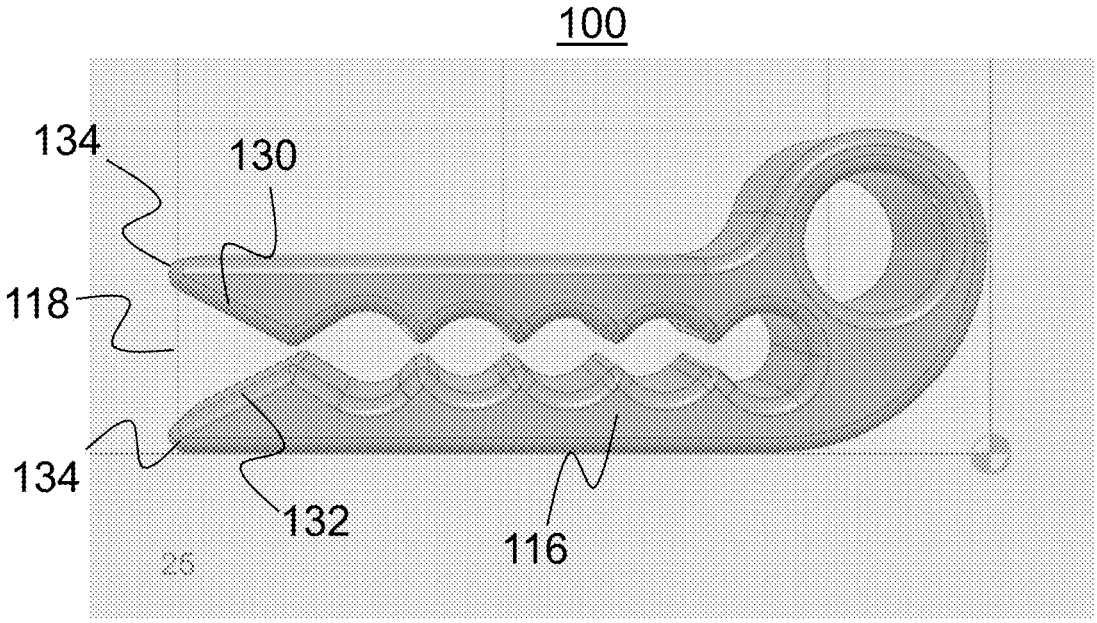
Figure 2C:
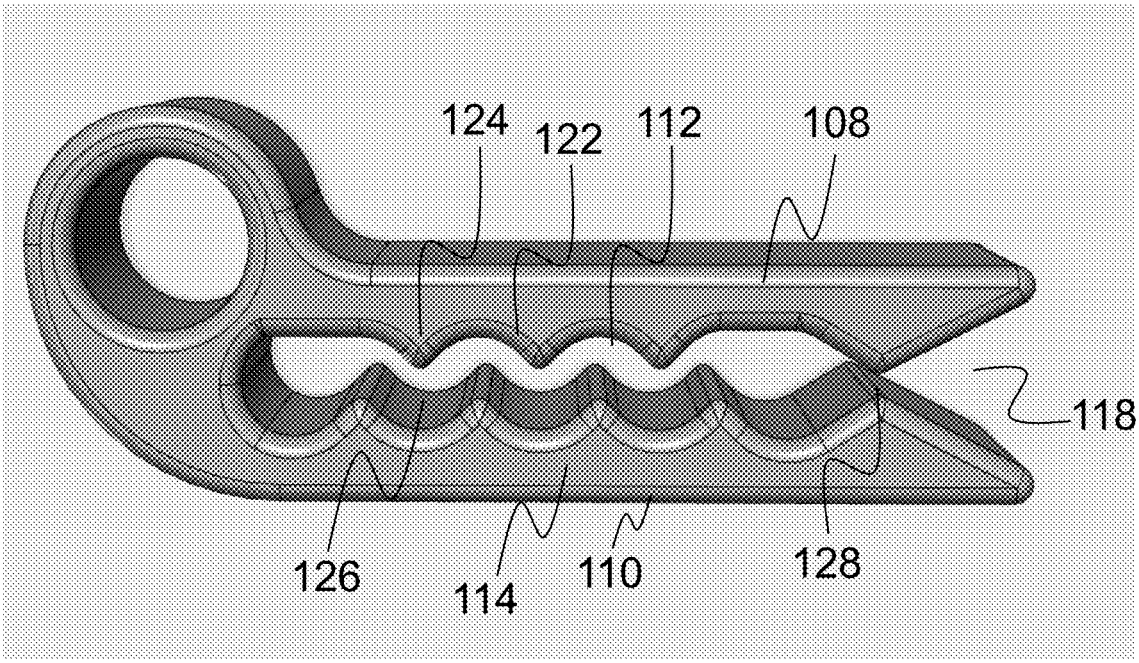

FIGS. 2A and 2B are side view illustrations of the shoe lace clip illustrating a first lateral side 114 and second lateral side 116 of the shoe lace clip 100 and more clearly illustrating the patterned surfaces of curved grooves and rounded teeth that help to safely and securely retain the shoe lace clip. The fixed clip opening 112 may have the patterned surfaces on one or both of the interior surfaces of the upper jaw 108 or lower jaw 110, with the patterns being symmetrical or asymmetrical to alter the ability of the clip to retain the shoe laces. In the embodiment shown in FIG. 2A, the patterned surfaces are symmetrical and include a series of curved, arch-liked grooves 122 which form a series of teeth 124 between each groove 122, while in FIG. 2C, the patterned surfaces are asymmetrical. If the grooves 122 and teeth 124 are symmetrical, they form a series of circular partial eyelets 126 which are shaped to retain a standard cylindrically-shaped shoe lace. The clip may have any number of grooves 122, teeth 124 and partial eyelets 126, but in one embodiment, approximately 4-6 of each with an approximate 20-30-millimeter (mm) groove width will result in a clip that is sizeable for clipping over a standard shoe lace knot.

In one embodiment, the teeth 126 extend partially into the clip opening 112 but do not touch, so as to allow a small gap between the teeth that is narrow enough to securely clamp down upon and retain the shoe lace knot or any individual shoe lace within the opening 112, but which is wide enough to allow a user to pull the shoe lace knot into the clip opening 112 without undue effort. For this same reason, the teeth 124 may also have rounded ends, as shown in FIG. 2A, which allow the knot or individual laces to slide more easily through the opening 112 when the clip is being placed onto (or removed from) the knot or laces. The rounded teeth 124 also prevent the laces from being snagged and torn by the teeth, preventing damage to the laces. Additionally, in one embodiment, a set of front teeth 128 disposed adjacent to the mouth 118 of the clip opening 112 may extend further into the clip opening 112 to provide a minimal gap at the mouth 118 to prevent the shoe lace knot or individual laces from sliding out from the clip opening 112.

As shown in FIG. 2B, at the mouth 118, the upper jaw 108 and lower jaw 110 may have an angled interior upper edge 130 and angled interior lower edge 132 which angle outward from the front teeth 128 to rounded corners 134, forming a wider mouth 118 to make it easier to insert the shoe lace knot into the fixed clip opening 112. The angled interior edges 130 and 132 may be flat to help a user slide the shoe lace knot or laces into the clip opening 112.

Figure 3A:
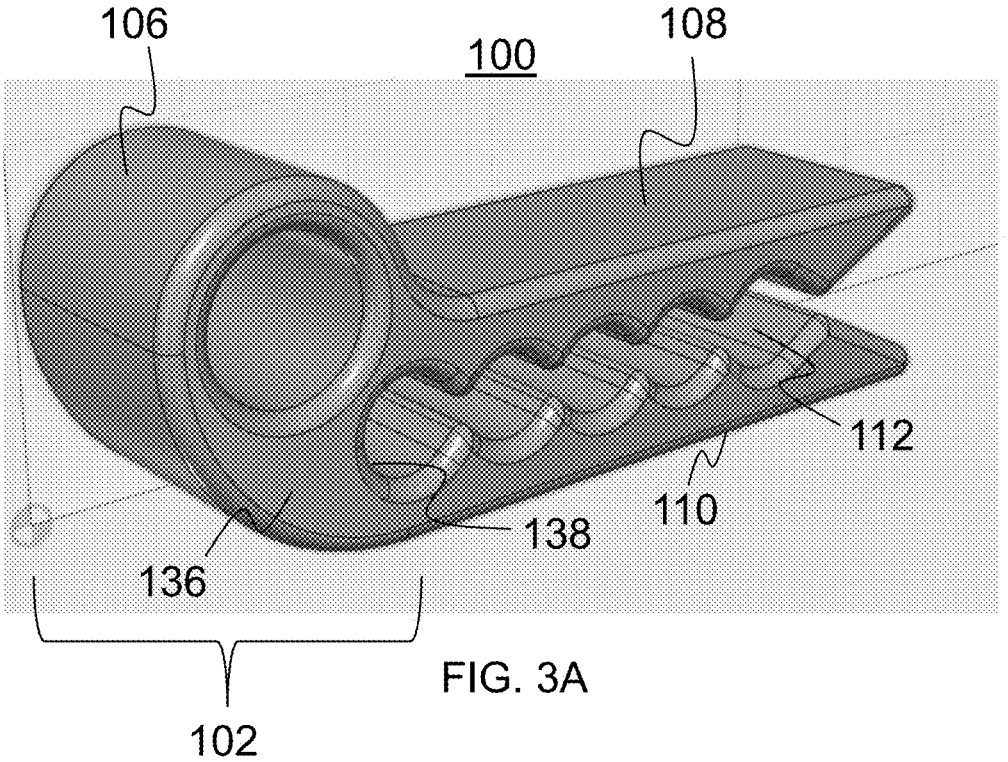
FIGS. 3A and 3B are perspective view illustrations of a back perspective and front perspective view of the shoe lace clip, according to an embodiment of the invention.
Figure 3B:
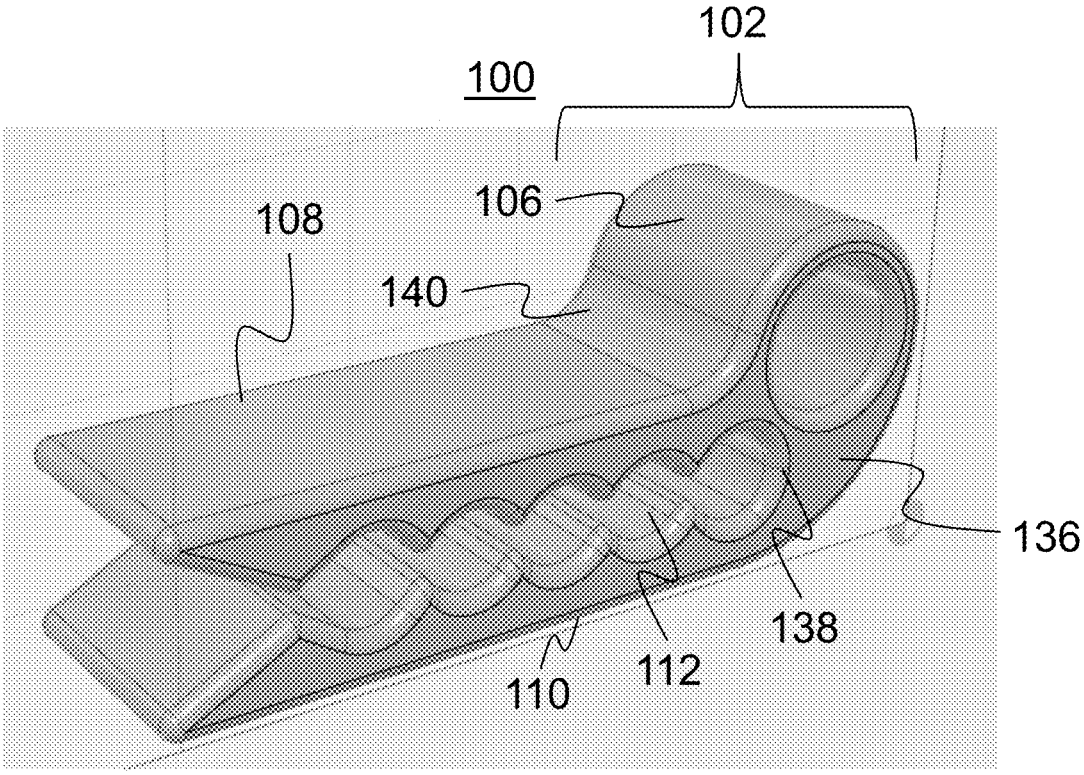

FIG. 3A is a perspective view illustration of a back right-side view of the shoe lace clip 100, more clearly illustrating the cylindrical shape of the base portion 102 and the extension of the side portion 106 into the upper jaw 108. An additional feature of the shoe lace clip 100 is a curved back 136 which forms a primary part of the extension of the base portion 102 to the clip portion 104. Along with the curved connection between the side portion 106 and the upper jaw 108, the curved back 136 stabilizes the clip opening 112 by helping to maintain the rigidity of the upper jaw 108 and lower jaw 110 while also reducing any stress that a hinge portion 138 of the clip opening 112 may endure as a result of forces being applied to open or close the jaws. FIG. 3B is a perspective view illustration of a front left-side view of the shoe lace clip 100 which more clearly shows a curved front 140 connecting the side portion 106 to the upper jaw 108, providing additional stability to the hinge portion 138 and maintaining the clip opening in its fixed width.

Figure 4A:
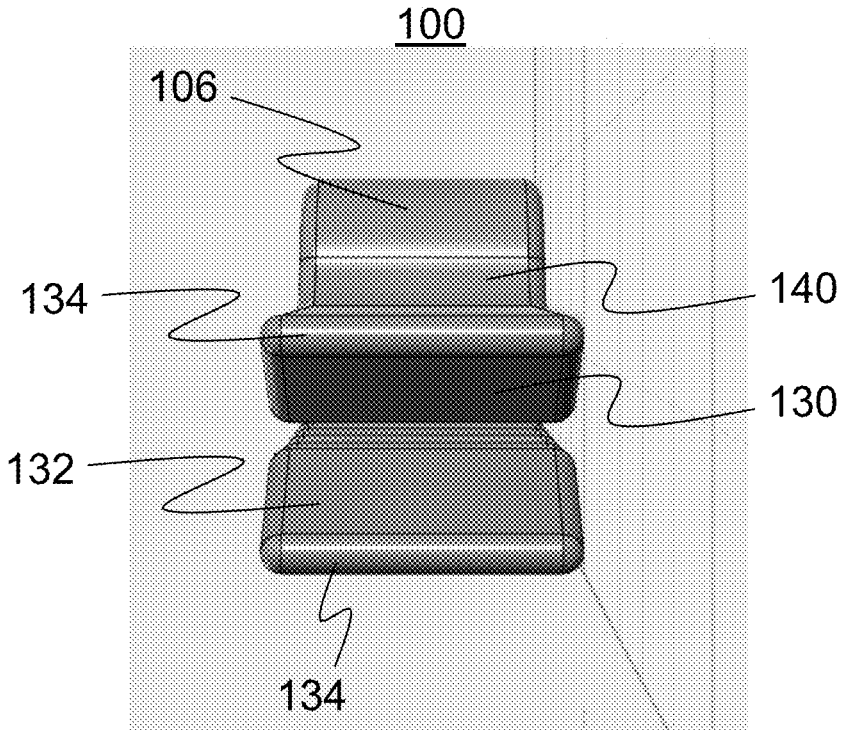
FIGS. 4A and 4B are front and rear-view illustrations of the shoe lace clip, according to an embodiment of the invention.
Figure 4B:
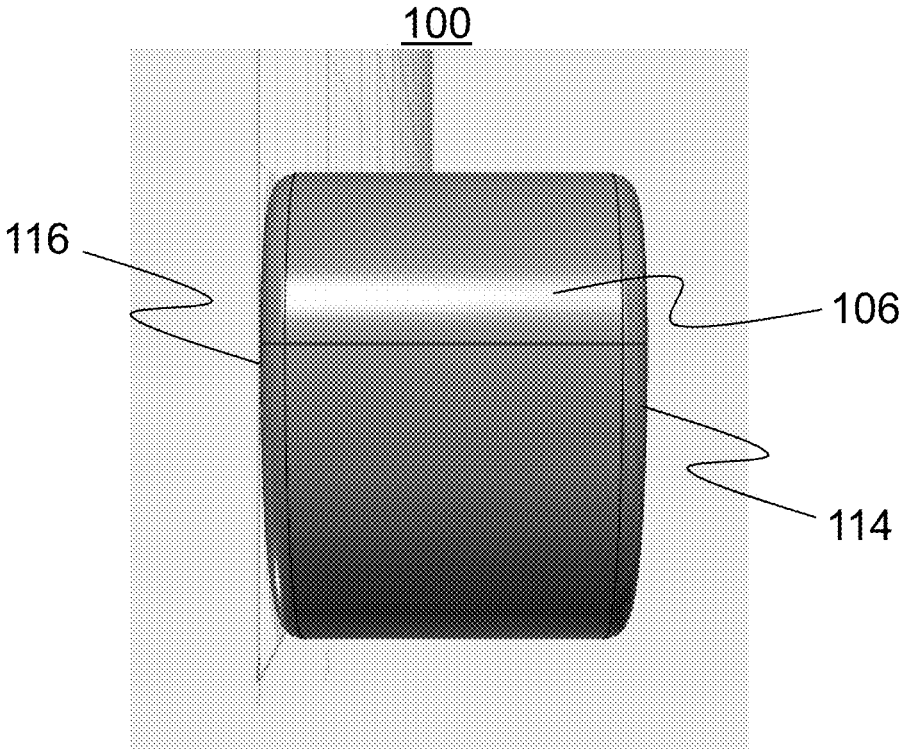

FIG. 4A is a front-view illustration of the shoe lace clip 100 which illustrates the interior upper edge 130 and interior lower edge 132 of the mouth 118, as well as the rounded corners 134 of the mouth 118. FIG. 4B is a rear-view illustration of the shoe lace clip 100 which shows the side portion 106 that forms the primary surface of the cylindrically-shaped base portion 102. For additional reference, the first lateral side 114 and second lateral side 116 of the clip 100 is identified.

Figure 5:
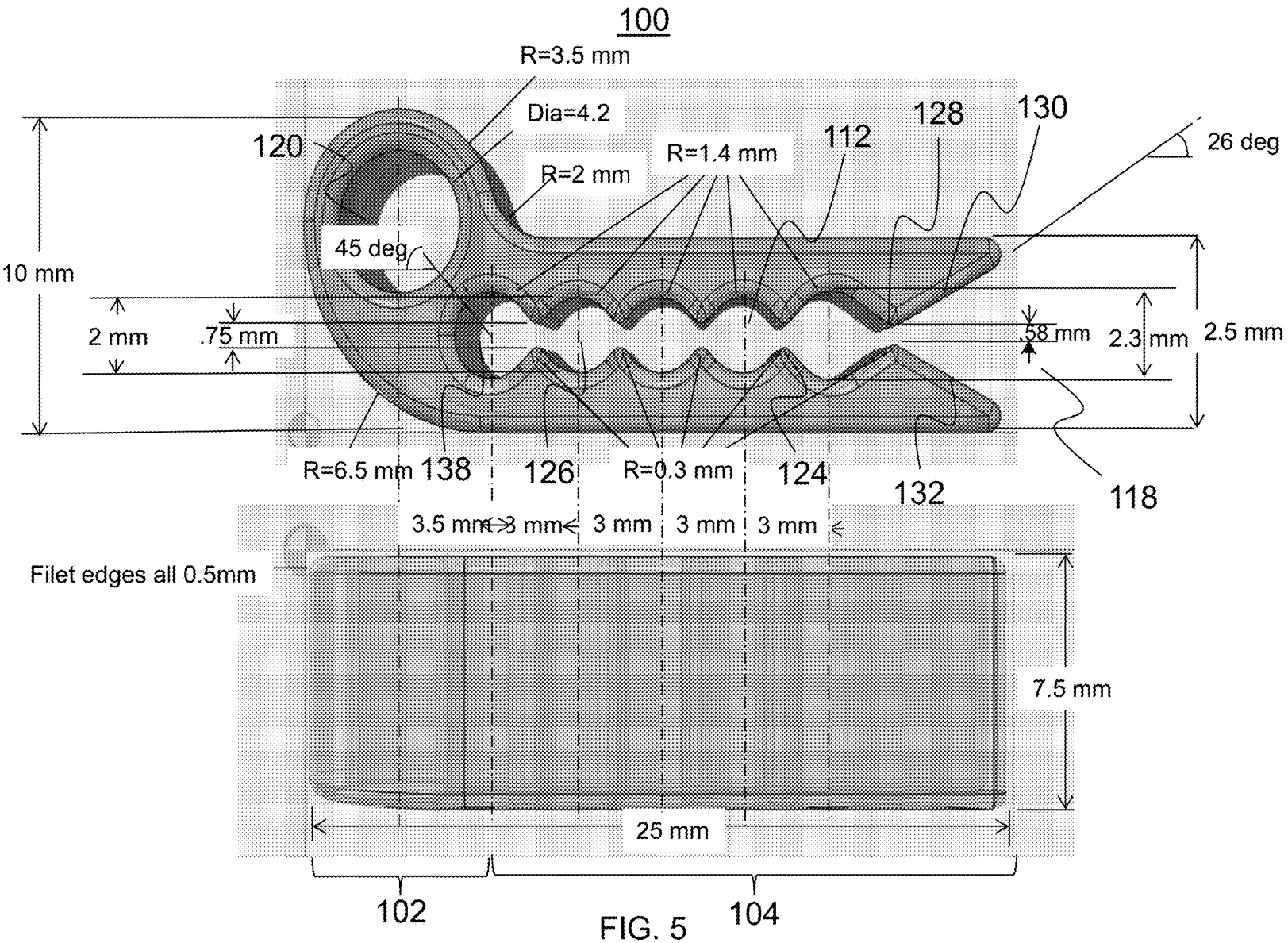
FIG. 5 is a scaled illustration of a side view and bottom view of the shoe lace clip, according to an embodiment of the invention.

FIG. 5 is a scaled illustration of a side view and bottom view of one embodiment of the shoe lace clip listing the approximate measurements of the various features described above. These measurements are exemplary of a shoe lace clip 100 configured to fit over a standard shoe lace and shoe lace knot, such that these approximate measurements could be increased or decreased for additional applications. In this particular embodiment, the length of the shoe lace clip is approximately 25 mm, the width is approximately 7.5 mm, and the height is approximately 10 mm, although the length may be approximately 20-30 mm, the width approximately 5-10 mm, and the height approximately 5-15 mm while still functioning optimally to clip the shoe lace knot.

In the illustrated embodiment, the height of the clip portion 104 is approximately 2.5 mm, which substantially corresponds to the height of the opening of the mouth 118 at it's widest point, while the gap between the front teeth 128 at approximately 0.58 mm. In the illustrated embodiment, the interior upper edge 130 and interior lower edge 132 extend at an angle of approximately 26 degrees. Further into the clip opening 112, the partial eyelets 126 have a radius of approximately 1.4 mm and an approximate width of 0.3 mm, with the gap between the teeth 124 approximately 0.75 mm.

In the embodiment shown herein, it should be noted that the eyelet 120 and the base portion 102 in general are located at an offset angle from the clip portion 104, such that the eyelet 120 is not planar with the clip opening 112. As illustrated in FIG. 5, the angle between the hinge portion 138 of the clip opening 112 and the center of the eyelet 120 is approximately 45 degrees relative to the plane extending through the clip opening 112. The offset position of the eyelet keeps the clip 100 flush against a top of the shoe when in use and makes the shoe lace clip 100 easier to grip and use. The offset angle may have a range of approximately −45 to 45 degrees depending on the particular shoe, laces, type of knot or other user-specific application.

Figure 6A:
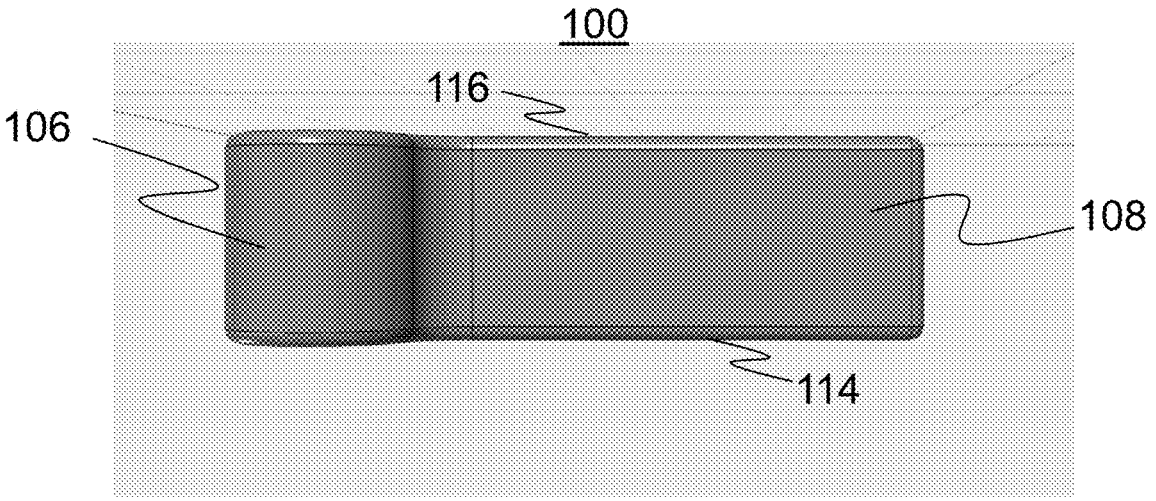
FIGS. 6A and 6B are top and bottom view images of the shoe lace clip, according to an embodiment of the invention.
Figure 6B:
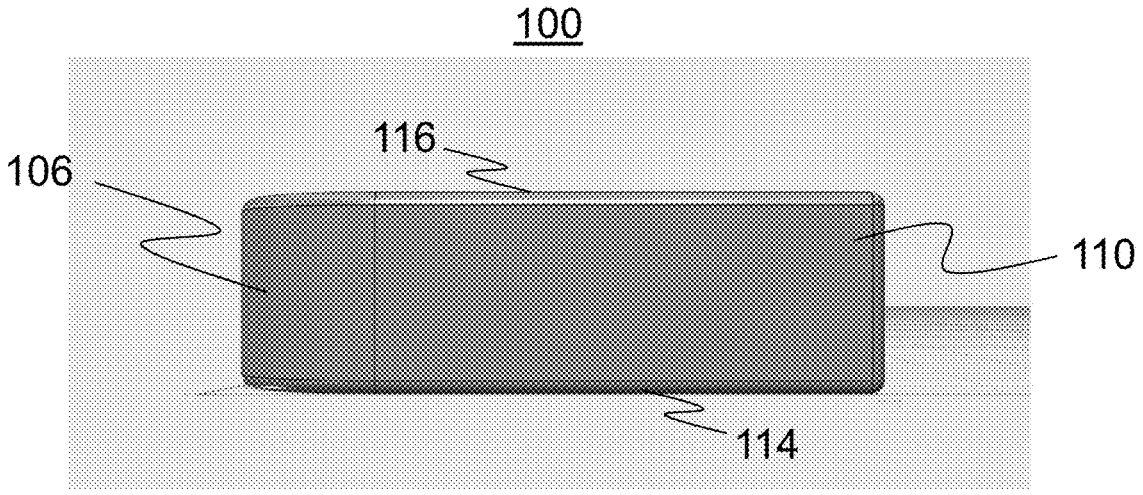
Figure 7:
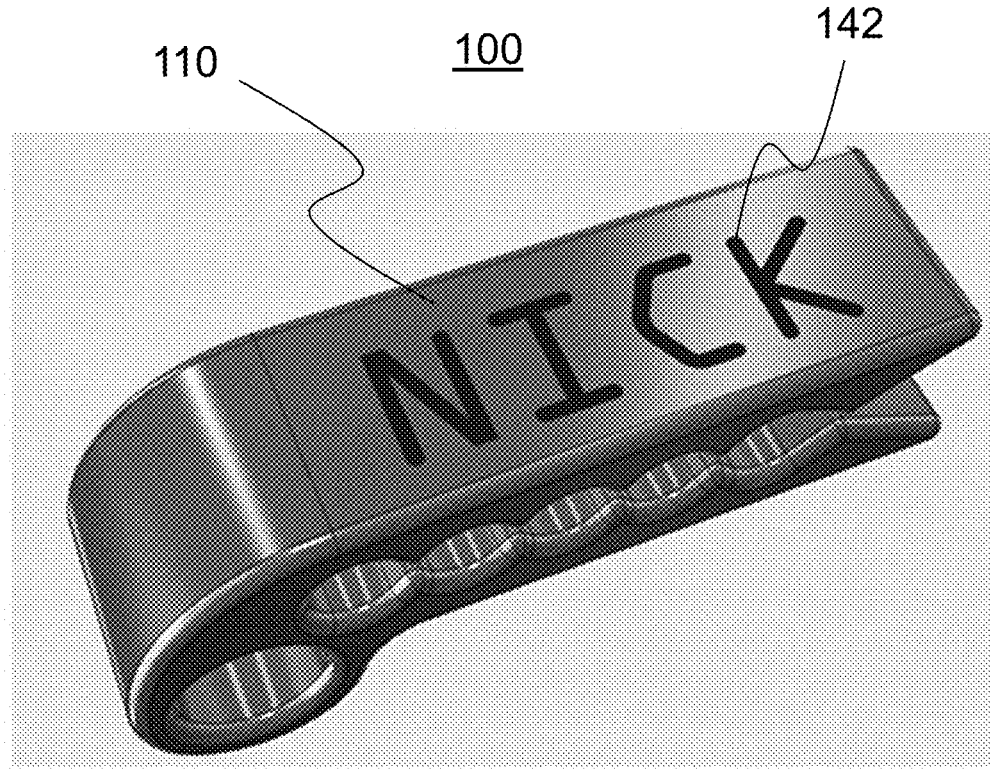
FIG. 7 is a top perspective view illustration of the shoe lace clip, according to an embodiment of the invention.

FIGS. 6A and 6B are top and bottom view images, respectively, of the shoe lace clip 100, illustrating the contours of the side portion 106 and the length of the upper jaw 108 and lower jaw 110, with the first lateral side 114 and second lateral side 116 identified for reference. In this embodiment, the surfaces of the upper jaw 108 and lower jaw 110 are substantially flat and may be labeled or covered with a design 142 or other indicia, as shown in FIG. 7. In one embodiment, the upper jaw 108 and lower jaw 110 may be configured into the shape of an animal's jaws, such as a crocodile or shark.

Figure 8A:
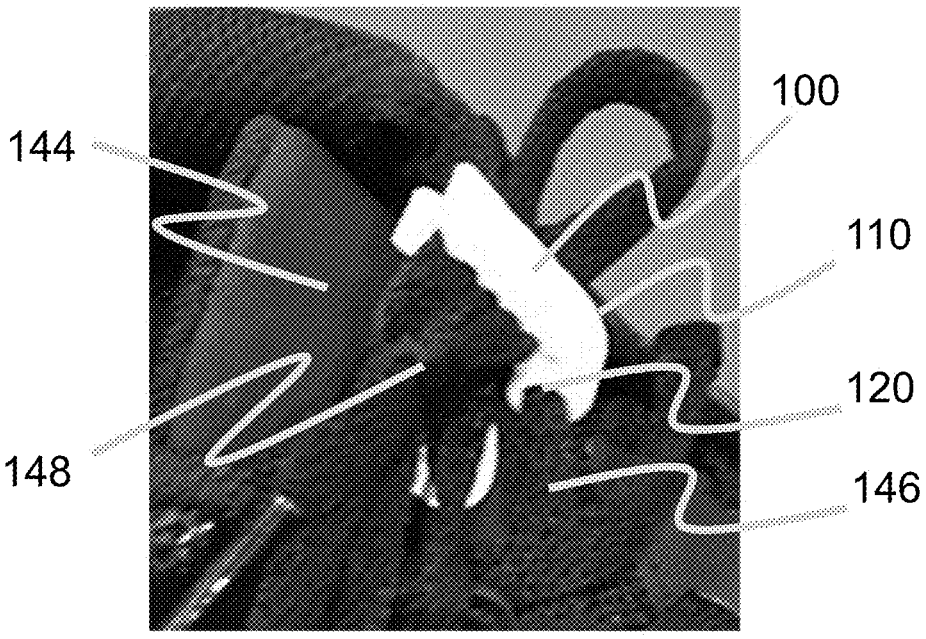
FIGS. 8A and 8B are images of the shoe lace clip positioned over a shoe lace knot, according to an embodiment of the invention.
Figure 8B:
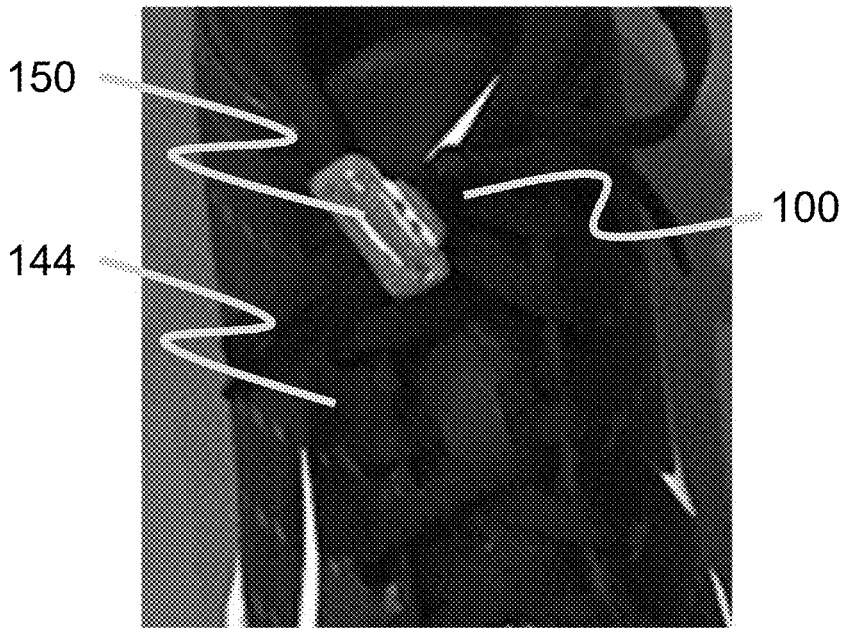

FIGS. 8A and 8B are images of the shoe lace clip 100 on a shoe 144, where a shoe lace 146 has been inserted through the eyelet 120 and the clip 100 has been inserted over a shoe lace knot 148. As can be seen in FIG. 8A, the clip 100 is positioned over the shoe lace knot such that the lower jaw 110 faces outward from the shoe 144 while the upper jaw 108 faces into the shoe 144 and is hidden from view. Additionally, the shoe lace 146 runs through the eyelet 120*b* below the shoe lace knot 148 with the clip portion extending upward toward a tongue of the shoe 144. The shoe lace clip 100 may be installed onto the shoe in any configuration or direction depending on a configuration of the laces, the shoe or even a user's preference. In FIG. 8B, the shoe lace clip 100 is covered by a shoe charm fixed to the lower jaw 110. The clip itself may be formed in any color to match a color of a shoe or shoe lace, or to provide specialized labeling or branding for a team, character, etc.

Figure 9:
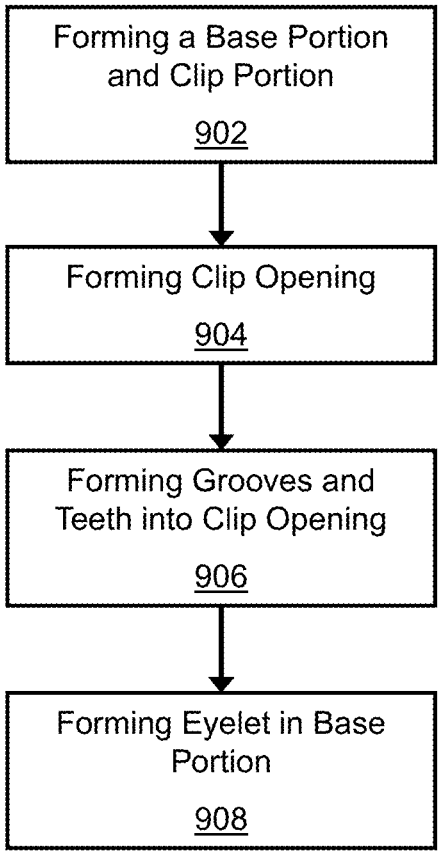
FIG. 9 is a block diagram illustrating an example method of manufacturing the shoe lace clip, according to an embodiment of the invention.

FIG. 9 is a block diagram of a method of manufacturing a shoe lace clip, in accordance with one embodiment of the invention. In step 902, a base portion and clip portion are formed as a single piece, such as with an industrial plastics extrusion or a 3D printer. In step 904, a clip opening is formed out of the clip portion, and in step 906, the grooves and teeth are patterned into the interior surfaces of the clip portion. Next, in step 908, an eyelet is formed into the base portion. Additional steps may be taken to form the base portion at an offset angle from the clip portion, as described above, or to form the angled mouth edges and the front teeth, as has been described above.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly not limited.

What is claimed is:

1. A shoe lace clip, comprising:

a base portion having an eyelet disposed therethrough; and a clip portion having an upper jaw and a lower jaw which each extend separately and independently from the base portion, and which are completely separated by a fixed clip opening, the fixed clip opening having a patterned surface of grooves and teeth including a mouth with an angled interior upper edge and an angled interior lower edge, and a pair of front teeth adjacent the mouth of the clip opening which extend further into the fixed clip opening than the other teeth.

2. The shoe lace clip of claim 1, wherein the clip portion and base portion are formed from a single piece of rigid material.

3. The shoe lace clip of claim 1, wherein the patterned surface includes curved grooves and rounded teeth.

4. The shoe lace clip of claim 3, wherein the grooves and rounded teeth are formed on an upper interior surface and an opposing lower interior surface.

5. The shoe lace clip of claim 4, wherein the patterned surface of curved grooves and rounded teeth on the upper interior surface is symmetrical with the patterned surface of curved grooves and rounded teeth on the lower interior surface.

6. The shoe lace clip of claim 4, wherein the patterned surface of curved grooves and rounded teeth on the upper interior surface is asymmetrical with the patterned surface of curved grooves and rounded teeth on the lower interior surface.

7. The shoe lace clip of claim 1, wherein the eyelet is disposed through the base portion in a direction perpendicular to the direction in which the clip portion extends from the base portion.

8. The shoe lace clip of claim 1, wherein the base portion is positioned at an offset angle with respect to the clip portion such that the base portion is non-planar with the fixed clip opening.

9. A method of manufacturing a shoe lace clip, the method comprising:

forming a base portion and clip portion, the clip portion having an upper jaw and a lower jaw extending separately and independently from the base portion;

forming a fixed clip opening into a substantial length of the clip portion opposite the base portion such that an upper jaw is completely separated from the lower jaw;

forming a patterned surface of grooves and teeth on surfaces of the clip opening;

forming the clip opening with a mouth having an angled interior upper edge and an angled interior lower edge;

forming a pair of front teeth adjacent the mouth of the clip opening which extend further into the fixed clip opening than the other teeth;

forming an eyelet in the base portion.

10. The method of claim 9, further comprising forming the base portion and the clip portion from a single piece of rigid material.

11. The method of claim 9, further comprising forming the patterned surface of curved grooves and rounded teeth.

12. The method of claim 11, further comprising forming the grooves and rounded teeth on an upper interior surface of the upper jaw and an opposing lower interior surface of the lower jaw.

13. The method of claim 12, further comprising forming the patterned surface of curved grooves and rounded teeth on the upper interior surface symmetrically with the patterned surface of curved grooves and rounded teeth on the lower interior surface symmetrically.

14. The method of claim 12, further comprising forming the patterned surface of curved grooves and rounded teeth on the upper interior surface asymmetrically with the patterned surface of curved grooves and rounded teeth on the lower interior surface.

15. The method of claim 9, further comprising disposing the eyelet through the base portion in a direction perpendicular to the direction in which the clip portion extends from the base portion.

16. A method of manufacturing a shoe lace clip, the method comprising:

forming a base portion and clip portion, the clip portion having an upper jaw and a lower jaw extending separately and independently from the base portion;

forming a fixed clip opening into a substantial length of the clip portion opposite the base portion such that an upper jaw is completely separated from the lower jaw;

forming a patterned surface of grooves and teeth on surfaces of the clip opening;

forming the clip opening with a mouth having an angled interior upper edge and an angled interior lower edge;

forming a pair of front teeth adjacent the mouth of the clip opening which extend further into the fixed clip opening than the other teeth;

forming an eyelet in the base portion;

positioning the base portion at an offset angle with respect to the clip portion such that the base portion is non-planar with the fixed clip opening.

* * * * *